US007328522B2

(12) United States Patent
Binder

(10) Patent No.: US 7,328,522 B2
(45) Date of Patent: Feb. 12, 2008

(54) DRYING CABINET COMPRISING A CLEANING DEVICE

(75) Inventor: Mathias Binder, Männedorf (CH)

(73) Assignee: Bucher Guyer AG, Niederweningen (CH)

( * ) Notice: Subject to any disclaimer, the term of this patent is extended or adjusted under 35 U.S.C. 154(b) by 120 days.

(21) Appl. No.: 10/511,340

(22) PCT Filed: Apr. 8, 2003

(86) PCT No.: PCT/CH03/00226

§ 371 (c)(1),
(2), (4) Date: Oct. 15, 2004

(87) PCT Pub. No.: WO03/087687

PCT Pub. Date: Oct. 23, 2003

(65) Prior Publication Data

US 2005/0235518 A1 Oct. 27, 2005

(30) Foreign Application Priority Data

Apr. 16, 2002 (CH) ..... 2002 0633/02

(51) Int. Cl.
*F26B 19/00* (2006.01)

(52) U.S. Cl. ..... 34/90

(58) Field of Classification Search ..... 34/58, 34/80, 208, 90, 218; 134/144
See application file for complete search history.

(56) References Cited

U.S. PATENT DOCUMENTS 3,868,835 A * 3/1975 Todd-Reeve ..... 68/20
4,732,172 A 3/1988 Pedersen
4,744,379 A * 5/1988 Goettel ..... 134/109
5,320,121 A * 6/1994 Alexanian ..... 134/123
6,076,274 A 6/2000 Dreisbach
6,158,146 A 12/2000 Kieselbach et al.
6,554,011 B1 4/2003 Bischoff et al.

FOREIGN PATENT DOCUMENTS

DE 36 09 115 C 6/1987
DE 198 08 408 C 6/1999
DE 100 28 895 A 12/2001
EP 1 055 462 A 11/2000

* cited by examiner

*Primary Examiner*—S. Gravini
(74) *Attorney, Agent, or Firm*—Cohen Pontani Lieberman & Pavane

(57) ABSTRACT

A drying system includes a drying cabinet having a plurality of horizontally heating plates, and a cleaning device which can be inserted into the interior of the cabinet. The cleaning device includes a carrier supported on the interior bottom of the drying cabinet and having a duct and a plurality of horizontal support arms with a cavity being fastened to the carrier, each cavity communicating with the duct. A support arm is arranged above each of the heating plates. Each of the support arms is outfitted with a spray arm which is rotatable horizontally around an axis A. Each spray arm has a quantity of nozzles. In addition, the carrier and the drying cabinet have means through which a cleaning agent can be supplied to the duct.

14 Claims, 4 Drawing Sheets

DRYING CABINET COMPRISING A CLEANING DEVICE

PRIORITY CLAIM

This is a U.S. national stage of application No. PCT/CH03/00226, filed on 4 Apr. 2003. Priority under 35 U.S.C. §119(a) and 35 U.S.C. §365(b) is claimed from Swiss Application No. 633/02, filed 16 Apr. 2002.

BACKGROUND OF THE INVENTION

1. Field of the Invention

The invention is directed to a drying cabinet having an interior with horizontally arranged heating plates, and a cleaning device which can be inserted into the interior.

2. Description of the Related Art

Drying cabinets of the kind mentioned above are used, for example, for drying pharmaceutical or chemical products or foods such as milk, proteins, soups, fruits, vegetables and the like. Drying is often carried out under vacuum and the drying cabinets are designed accordingly.

These drying cabinets become soiled in operation and this dirt must be eliminated by cleaning. Formerly, this was performed manually; but guidelines have existed for some time which can only be met when cleaning devices are provided whose operation can be documented.

A drying cabinet of this type is known from U.S. Pat. No. 6,076,274. Its upper wall has a pipe connection piece which can be closed in a vacuum-tight manner, a cleaning device being insertable into the interior of the drying cabinet through this pipe connection piece. This cleaning device, which is driven by a motor, has jets or nozzles through which the cleaning fluid can be sprayed into the individual tiers of the drying cabinet. The jet of cleaning agent exits the nozzle horizontally. Because the nozzle is swivelable horizontally, the jet can also reach the corners of the interior of the drying cabinet.

A drying cabinet which is outfitted with a stationary cleaning device is known from DE-A1-100 28 895. Pipes arranged on both sides of the shelves have a plurality of nozzles through which the cleaning agent can be sprayed onto the individual shelves.

DE-C1-36 09 115 discloses a baking oven having a device for supplying expanded wet steam. Further, there is a rinsing device by means of which suds can be introduced into the baking chamber through spray nozzles.

U.S. Pat. No. 4,732,172 discloses a washing device for transfer carts and U.S. Pat. No. 6,554,011 discloses a device for cleaning germination decks. Further, a drying device is known from U.S. Pat. No. 6,158,146.

SUMMARY OF THE INVENTION

It is the object of the invention to provide a drying cabinet with a cleaning device whose cleaning action is further improved compared to the previously known prior art.

According to the invention, the cleaning device includes a vertical carrier having a duct, and a plurality of support arms extending horizontally from the carrier into intermediate spaces formed by the heating plates and the top and bottom of the interior, each support arm having a cavity communicating with the duct. A plurality of spray arms are rotatably mounted on respective support arms, each spray arm having a plurality of nozzles connected to a respective cavity.

DETAILED DESCRIPTION OF THE DRAWINGS

Figure 1:
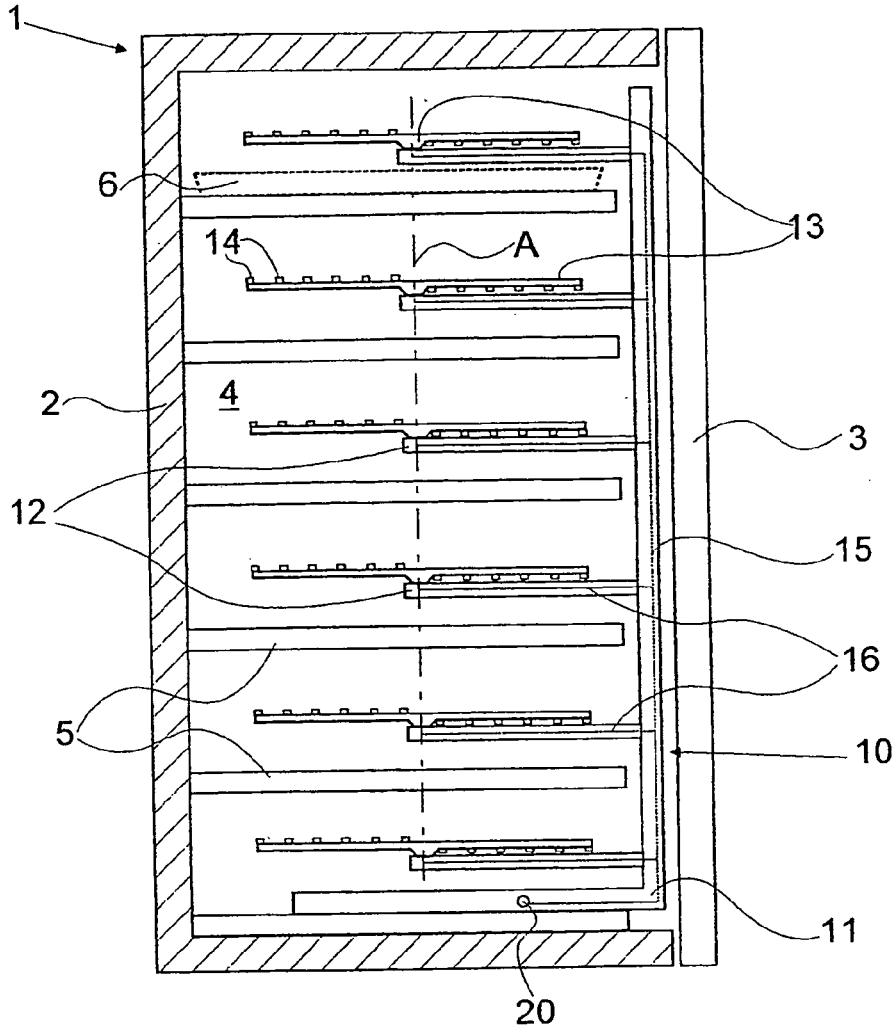
FIG. 1 shows a vertical section through a drying cabinet with a view of a cleaning device.

In FIG. 1, a drying cabinet 1 comprises a housing cube 2 which is open on one side and which can be closed on the open side by a door 3. When the drying cabinet 1 is designed as a vacuum drying cabinet, a seal, not shown, is fastened to the door 3. The interior 4 of the drying cabinet 1 is subdivided by heating plates 5 which are designed as shelves upon which product trays 6 can be placed. These product trays 6 are removable. Therefore, they can be cleaned outside of the drying cabinet 1 in a particularly efficient manner. Only one of the product trays 6, that on the topmost heating plate 5, is shown. All product trays 6 are removed from the drying cabinet 1 when cleaning work is performed on the drying cabinet 1; for this reason, the one product tray 6 is indicated in dashed lines to show its position. The bottom of the drying cabinet 1 can also contain a heating plate 5.

A cleaning device 10 is inserted into the drying cabinet 1. This cleaning device 10 is either arranged in a stationary manner in the drying cabinet 1 or can advantageously be inserted into and then removed from the drying cabinet 1. This is shown again in detail. When the cleaning device 10 is removable, it can be used successively for a plurality of drying cabinets 1. This economizes on capital investment because only one cleaning device 10 need be procured for a large number of drying cabinets.

The cleaning device 10 comprises a support or carrier 11 to which is attached a plurality of horizontal support arms 12. The quantity of support arms 12 is equal to the quantity of intermediate spaces between the top of the interior space 4, the heating plates 5 and the bottom of the interior space 4 of the drying cabinet 1. A spray arm 13 which rotates around the vertical axis A is rotatably arranged at each of the support arms 12. Every spray arm 13 is outfitted with a quantity of nozzles 14. These nozzles 14 are so constructed in a known manner that the liquid jet exits at an inclination to the longitudinal axis of the spray arm 13 so that the spray arm 13 is set in rotation about the axis A by the recoil of the spray jet. Accordingly, a motorized drive unit of the spray arm 13 can be dispensed with. The carrier 11 has a duct 15 in its interior through which the cleaning agent reaches the support arms 12 and then, through cavities 16 in the support arms 12, arrives at the spray arms 13.

In the present embodiment example, the carrier 11 is supported on the interior bottom of the drying cabinet 1. It can be fixedly mounted thereon or can simply rest upon this interior base so that it can be removed. Other solutions are possible within the framework of the invention; for example, supporting on the heating plates 5, e.g., the topmost heating plate 5, or supporting in guide rails at the two side walls of the interior space 4 of the drying cabinet 1.

The carrier 11 has an opening 20 through which the cleaning agent can enter into the duct 15. The cleaning agent which can be supplied in this way then travels through the duct 15 to the cavities 16 of the individual support arms 12 and arrives at the interior of the individual spray arms 13, through whose nozzles 14 it can be sprayed into the interior 4 of the drying cabinet 1.

A closable bore hole in the bottom of the drying cabinet 1 through which the cleaning agent can flow is known from U.S. Pat. No. 6,076,274, but is not shown.

Figure 2:
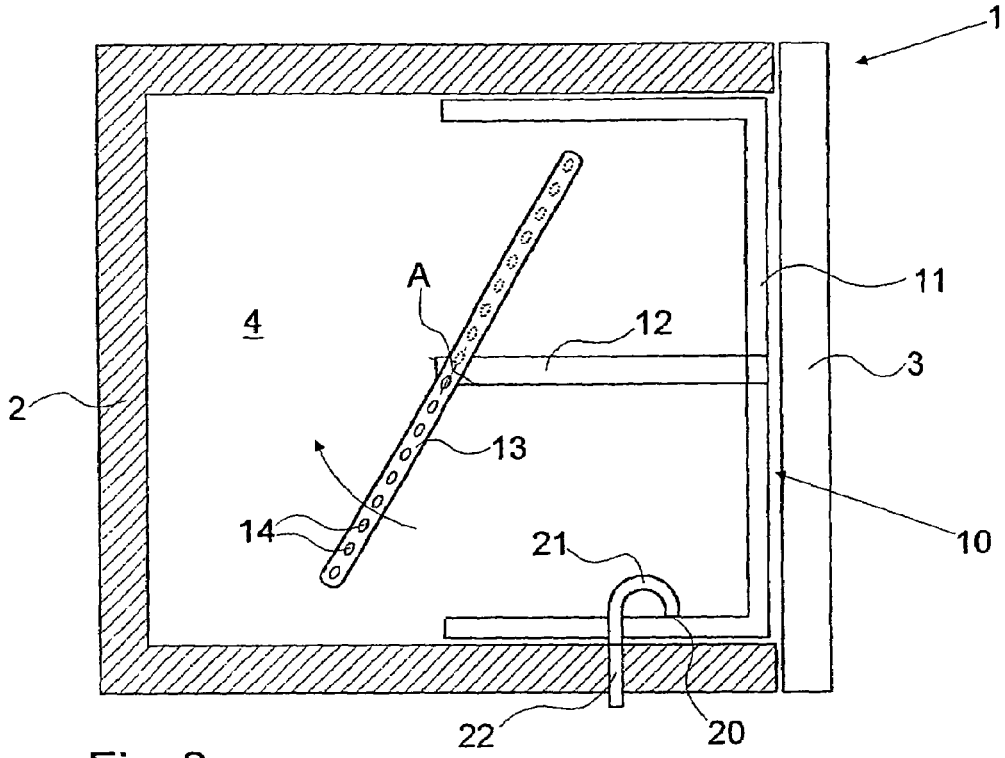
FIG. 2 shows a horizontal section with a top view of the cleaning device.

FIG. 2 shows a horizontal section through the drying cabinet 1 with a top view of the cleaning device 10. Also shown is a top view of a support arm 12 which is connected to the carrier 11 and a spray arm 13 which is fastened to the support arm 12 so as to be rotatable around the axis A. The spray arm 13 has nozzles 14. On one of the legs of the spray arm 13, the nozzles 14 lie on top and so are indicated in FIG. 2 by solid lines, whereas on the other leg they are arranged on the underside and are therefore shown in dashed lines. The rotation of the spray arm 13 around the axis A is indicated by an arrow.

The opening 20 in the carrier 11 is also shown. A connection piece 21 adjoins this opening 20 and is connected at the other side to a pipe guide-through 22 which penetrates the side wall of the housing cube 2 of the drying cabinet 1. Couplings at this pipe guide-through 22 by which the connection piece 21 can easily be connected to the pipe guide-through 22 and by which this pipe guide-through can easily be connected to a connection line, not shown, for the cleaning agent are not shown because the known prior art contains usable solutions for this. The drawings also do not show means by which the pipe guide-through 22 can be closed in a tight manner when the cleaning device 10 has been removed from the drying cabinet 1.

Figure 3:
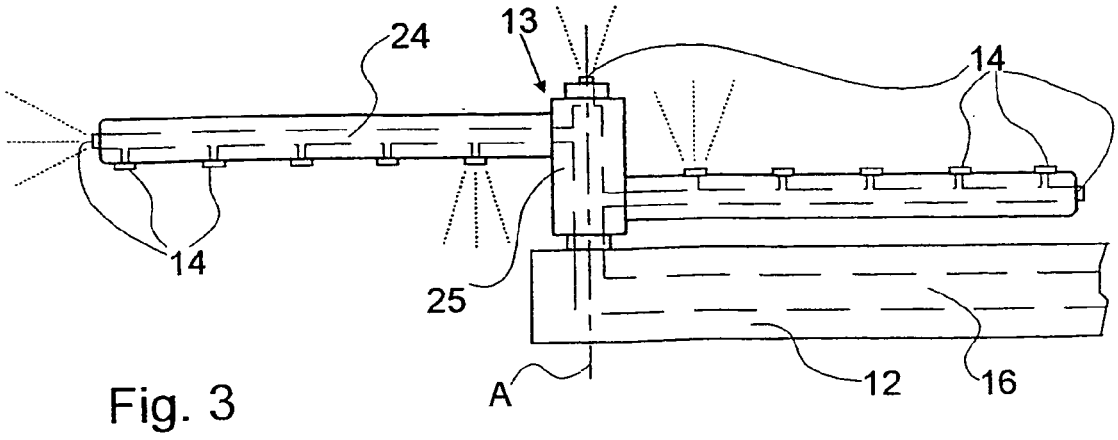
FIG. 3 shows details of a spray arm.

FIG. 3 shows an advantageous construction of a spray arm 13 with its nozzles 14. Also shown is a flow duct 24 which communicates with the cavity 16 of the support arm 12. Accordingly, the cleaning agent can flow from the cavity 16 into the flow duct 24 and can then enter the interior 4 (FIG. 1) of the drying cabinet 1 through the individual nozzles 14.

Nozzles 14 which spray approximately horizontally are advantageously provided at the radial ends of the spray arm 13, which serves to distribute the cleaning agent in the interior 4 in an optimal manner. Another nozzle 14 in the middle portion 25 of the spray arm 13 also serves this purpose. The step whereby the two legs of the spray arm 13 are arranged so as to be offset in height also serves for optimal distribution of the cleaning agent. The leg having nozzles 14 spraying upward is arranged farther down, while the leg having nozzles 14 spraying downward is arranged farther up.

Figure 4:
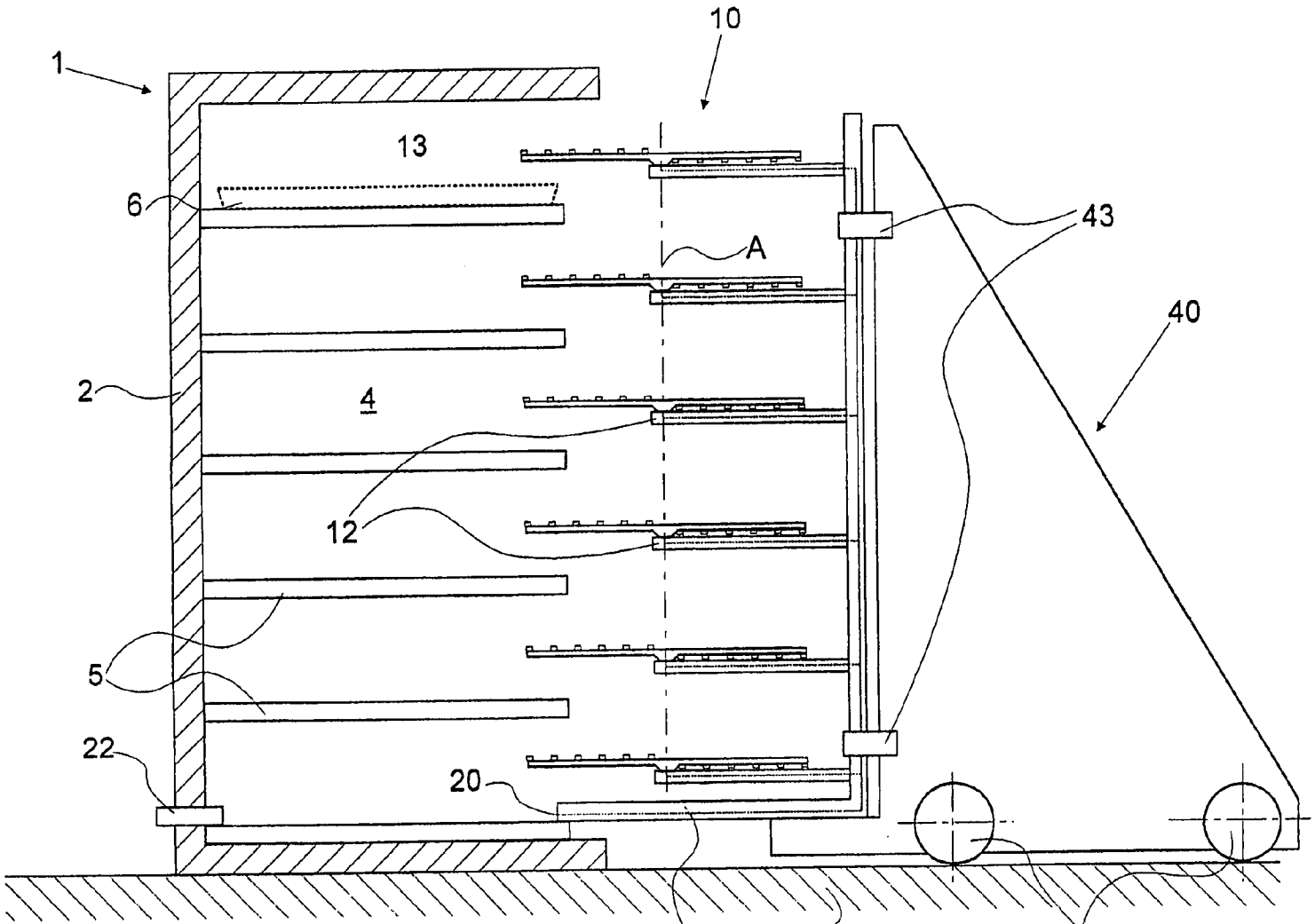
FIG. 4 shows a device for transporting the cleaning device.

FIG. 4 shows the drying cabinet 1 with open door 3, not shown, and a device for transporting the cleaning device 10. Drying cabinets 1 for the chemical, pharmaceutical and foodstuffs industries can have substantial dimensions, e.g., approximately 2×2×2 m. The cleaning device 10 has corresponding dimensions and, therefore, considerable weight. A transporting device 40 of this kind is advantageous for enabling one person to cope with inserting the cleaning device 10 into and removing it from the drying cabinet 1. The transporting device 40 is movable by means of wheels 41 on the surface 42 upon which the drying cabinet 1 stands. The transporting device 4 has coupling means 43 by which the cleaning device 10 can be connected to the transporting device 40 in a frictional engagement.

It can be seen from FIGS. 1 and 2 that owing to the shape of the cleaning device 10 it is not possible to remove the product trays 6 from or insert them into the drying cabinet 1 when the cleaning device 10 is inserted in the drying cabinet 1. However, this is only true when the product trays 6 are so dimensioned that they correspond approximately to the width and depth of the heating plates 5. With smaller product trays 6, this problem does not occur. Accordingly, before the drying cabinet 1 can be loaded or unloaded when using product trays 6 of this size, the cleaning device 10 must be removed from the drying cabinet 1. The transporting device 40 which is shown schematically advantageously serves for this purpose. The transporting device 40 is also applied when a cleaning device 10 is used for a plurality of drying cabinets 1 successively as was already mentioned above.

Further, in contrast to FIGS. 1 and 2, FIG. 4 shows a different placement of the connection of the cleaning device 10 for supplying with cleaning agent. In this instance, the pipe guide-through 22 is arranged in the rear wall of the drying cabinet 1 and the opening 20 is located at a front side of the carrier 11 facing the pipe guide-through 22. The opening 20 and the pipe guide-through 22 can be constructed as a quick-coupling, so that the cleaning device 10 is automatically coupled to a line for the cleaning agent when the cleaning device 10 is moved into the drying cabinet 1.

Figure 5:
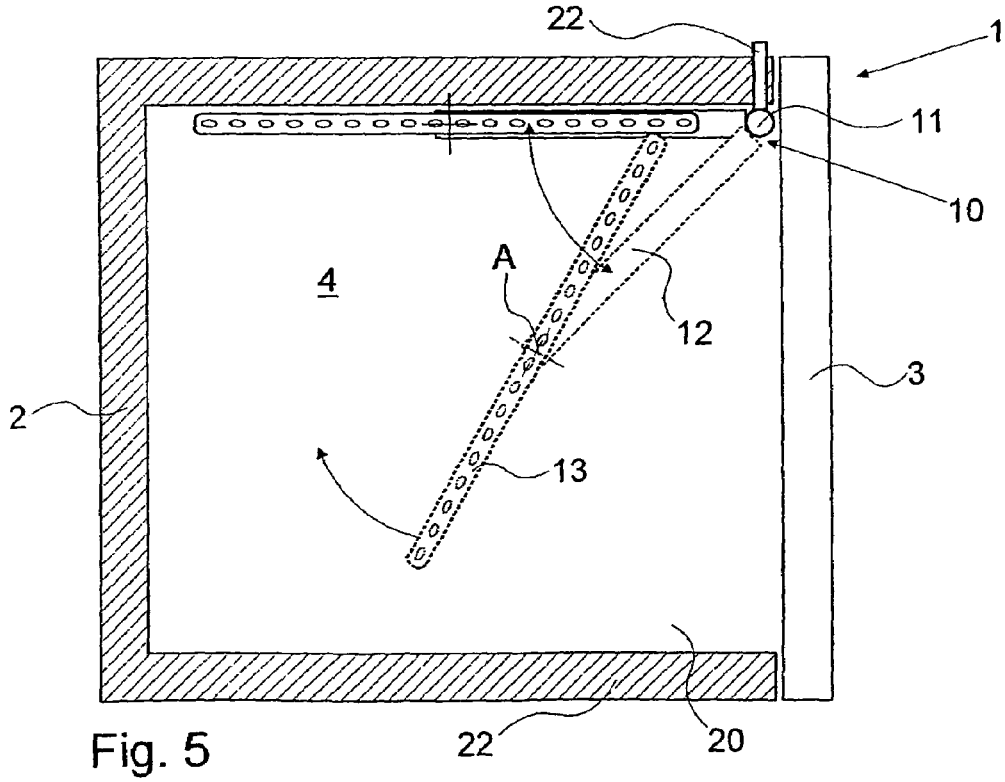
FIG. 5 shows a drying cabinet with integrated cleaning device.

If the cleaning device 10 is to be an integral component part of the drying cabinet 1, that is, not removable, the carrier 11 is advantageously designed in such a way that it does not impede insertion and removal of large product trays 6. An advantageous construction of this kind is shown in FIG. 5.

In this case, the carrier 11 is arranged in one of the corners of the drying cabinet 1. The support arms 12 which are fastened to the carrier 11 are swivelable. Accordingly, the carrier 11 with the support arms 12 rigidly fastened thereto can be rotatable around its own axis or the support arms 12 can be swivelable around the carrier 11. The idle position of the support arms 12 with the spray arm 13 fastened thereto is indicated by solid lines in FIG. 5; the position occupied when carrying out cleaning is shown by dashed lines. In this case, the support arm 12 projects diagonally into the interior 4 of the drying cabinet 1 toward its center.

Figure 6:
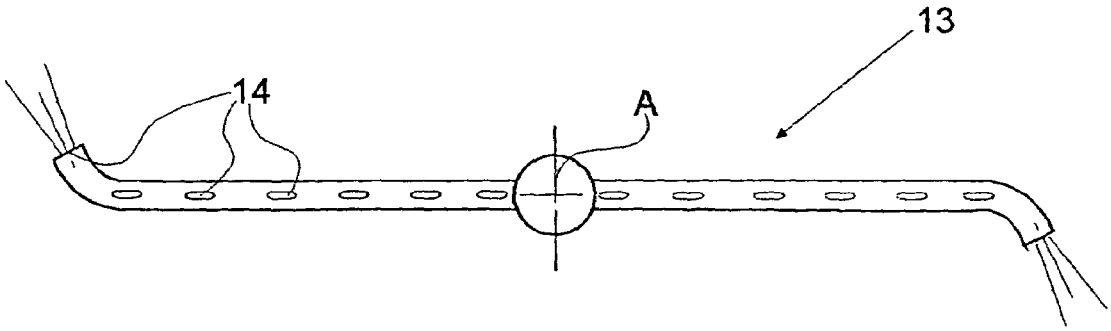
FIG. 6 shows a variant of a spray arm.

A variant of a spray arm 13 is shown in a schematic top view in FIG. 6. As in the embodiment example in FIG. 3, the nozzles 14 of one arm spray downward and those of the other arm spray upward. The nozzles 14 at the radial ends of the spray arm 13 do not spray in radial direction, but rather at an appreciable inclination to the longitudinal axis of the spray arm 13, which produces the force for the rotation of the spray arm 13 around its axis of rotation A as a result of the recoil of the spray jet.

Further constructions are possible within the framework of the general idea of the invention. In sum, a drying cabinet (1) with a cleaning device (10) having an improved cleaning action is provided by means of the invention and its variants.

The invention claimed is:

1. A drying system comprising a drying cabinet and a cleaning device, the drying cabinet comprising an interior having a top, a bottom, and a plurality of heating plates arranged horizontally between the top and the bottom to form a plurality of intermediate spaces between said heating plates, the cleaning device being insertable into said cabinet and comprising:

a vertical carrier having a duct;

a plurality of support arms extending horizontally from the carrier into respective said intermediate spaces between said heating plates, each support arm having a cavity which communicates with the duct; and a plurality of spray arms horizontally rotatably mounted on respective said support arms, each said spray arm having a plurality of nozzles connected to a respective said cavity.

2. A drying system as in claim 1 wherein at least one of said nozzles on each said spray arm is mounted to spray liquid at an acute angle with respect to a horizontal plane, thereby caused said spray arm to rotate when water is being sprayed.

3. A drying system as in claim 1 wherein the carrier is fixed in the drying cabinet.

4. A drying system as in claim 3 wherein the carrier is mounted in a corner of the drying cabinet whereby the duct extends vertically in the corner of the drying cabinet.

5. A drying system as in claim 1 wherein the cleaning device is removable from the drying cabinet as a unit.

6. A drying system as in claim 5 further comprising a transporting device having couplings which engage the carrier.

7. A drying system as in claim 1 wherein each said spray arm has a first leg having nozzles which spray upward and a second leg having nozzles which spray downward, said second leg being radially opposite and above said first leg.

8. A drying system as in claim 1 wherein each said spray arm has radially opposed ends, each said end having a nozzle which sprays substantially horizontally.

9. A drying system as in claim 1 further comprising a nozzle arranged on the axis of rotation of the spray arm.

10. A drying system as in claim 1 wherein the spray arms are mounted for rotation about a common vertical axis.

11. A drying system as in claim 1 wherein said cabinet further comprises an opening for supplying cleaning agent to said interior, said duct in said vertical carrier being coupled to said opening to supply cleaning agent to said spray arms.

12. A cleaning device for a drying cabinet of the type comprising an interior having a top, a bottom, and a plurality of heating plates arranged horizontally between the top and the bottom to form a plurality of intermediate spaces between the heating plates, the cleaning device being insertable into said interior and comprising:

a vertical carrier having a duct;

a plurality of support arms extending horizontally from the carrier and spaced to be received in respective said intermediate spaces between said heating plates, each support arm having a cavity which communicates with the duct;

a plurality of spray arms horizontally rotatably mounted on respective said support arms, each said spray arm having a plurality of nozzles connected to a respective said cavity; and a transporting device which is coupled to said carrier to facilitate inserting said carrier into said interior of said drying cabinet.

13. The cleaning device of claim 12 wherein said duct in said carrier can be coupled to an opening in said cabinet for supplying cleaning agent to said interior, whereby cleaning agent can be supplied to said spray arms.

14. The cleaning device of claim 12 wherein each said spray arm has nozzles directed upward and nozzles directed downward.

* * * * *